United States Patent [19]

Jenny et al.

[11] Patent Number: 5,052,362

[45] Date of Patent: Oct. 1, 1991

[54] GAS-DYNAMIC PRESSURE-WAVE SUPERCHARGER WITH EXHAUST BYPASS

[75] Inventors: Ernst Jenny, Baden; Jbrahim El-Nashar, Kloten; Dominique Stohr, Birmenstorf, all of Switzerland

[73] Assignee: Comprex AG, Baden, Switzerland

[21] Appl. No.: 395,503

[22] Filed: Aug. 18, 1989

[30] Foreign Application Priority Data

Aug. 23, 1988 [CH] Switzerland ..... 3123/88

[51] Int. Cl.[5] ..... F02B 33/00

[52] U.S. Cl. ..... 123/559.2; 60/602

[58] Field of Search ..... 60/602; 123/559.2; 417/62

[56] References Cited

U.S. PATENT DOCUMENTS

| | | | |
|---|---|---|---|
| 2,800,120 | 7/1957 | Jendrassik | 123/559.2 |
| 3,104,520 | 9/1963 | Cazier | 60/602 |
| 4,463,564 | 8/1984 | McInerney | 60/602 |
| 4,592,330 | 6/1986 | Mayer | 60/602 |

FOREIGN PATENT DOCUMENTS

| | | | |
|---|---|---|---|
| 0080741 | 9/1982 | European Pat. Off. . | |
| 1049401 | 7/1959 | Fed. Rep. of Germany . | |
| 3101131 | 8/1982 | Fed. Rep. of Germany . | |
| 25505 | 2/1980 | Japan | 60/605.1 |
| 294622 | 2/1954 | Switzerland . | |
| 342039 | 12/1959 | Switzerland . | |
| 845183 | 8/1960 | United Kingdom . | |

*Primary Examiner*—Douglas Hart

*Attorney, Agent, or Firm*—Burns, Doane, Swecker & Mathis

[57] ABSTRACT

In the case of a gas-dynamic pressure-wave supercharger for the supercharging of an internal combustion engine, an exhaust bypass in the gas housing (2), with a medium-controlled gate, connects the high-pressure gas inflow duct (4) to the low-pressure gas outflow duct (6). The exhaust gas blown off is introduced via a waste gate ejector (33), which is located in the region of the closing edge (30) in the low-pressure gas outflow duct (6), into the latter. Consequently, the energy level of the low-energy scavenging air can be increased, which improves the compression efficiency of the pressure-wave supercharger.

4 Claims, 2 Drawing Sheets

Fig.1
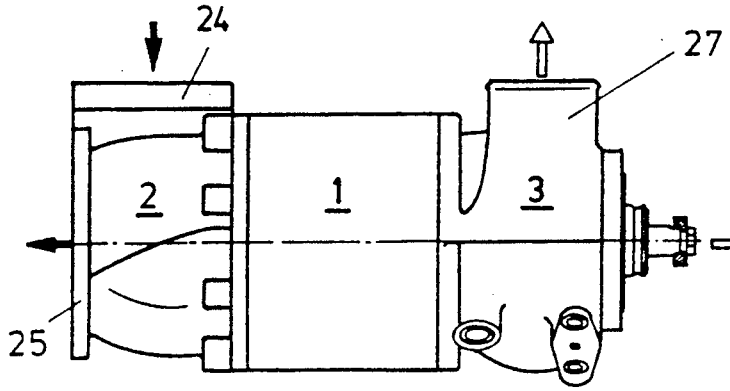
Fig.2
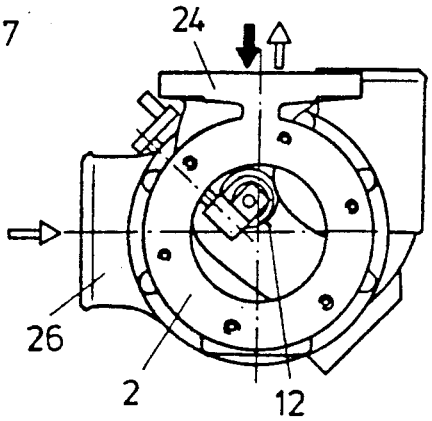
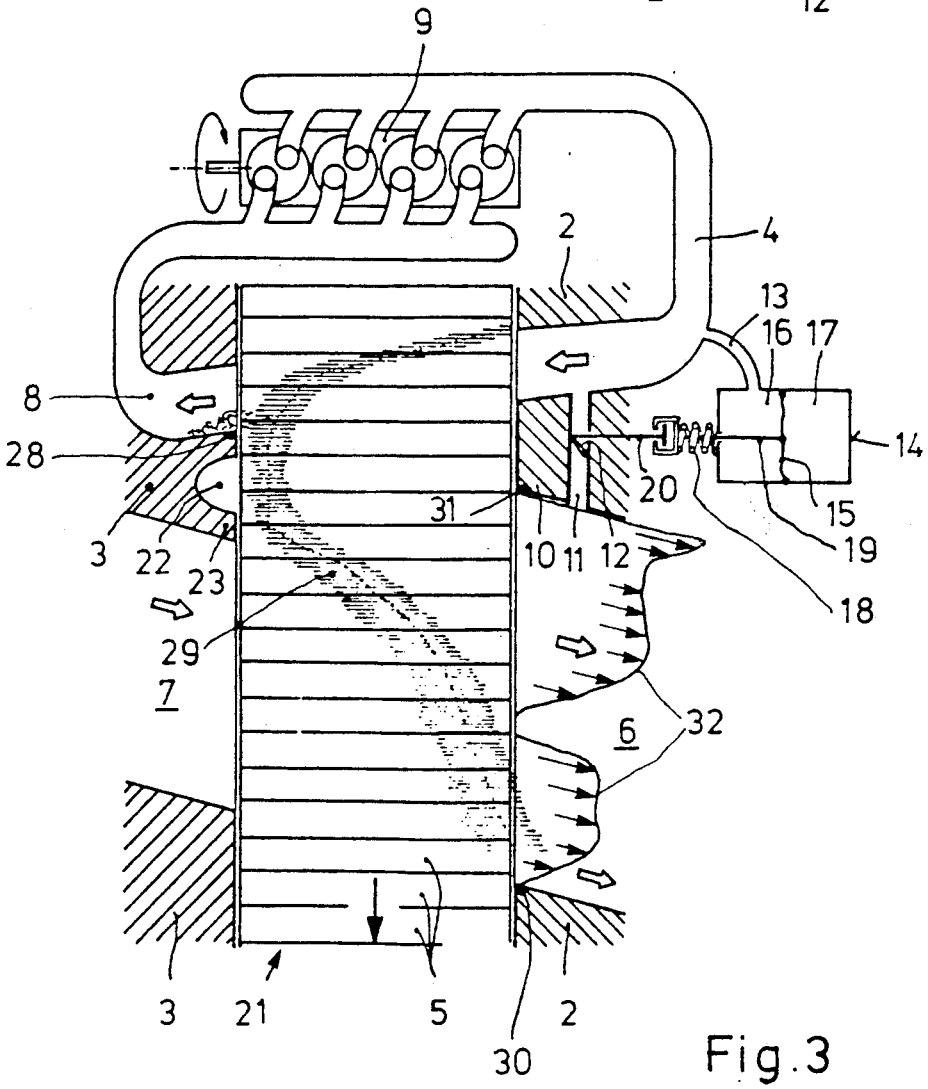
Fig.3

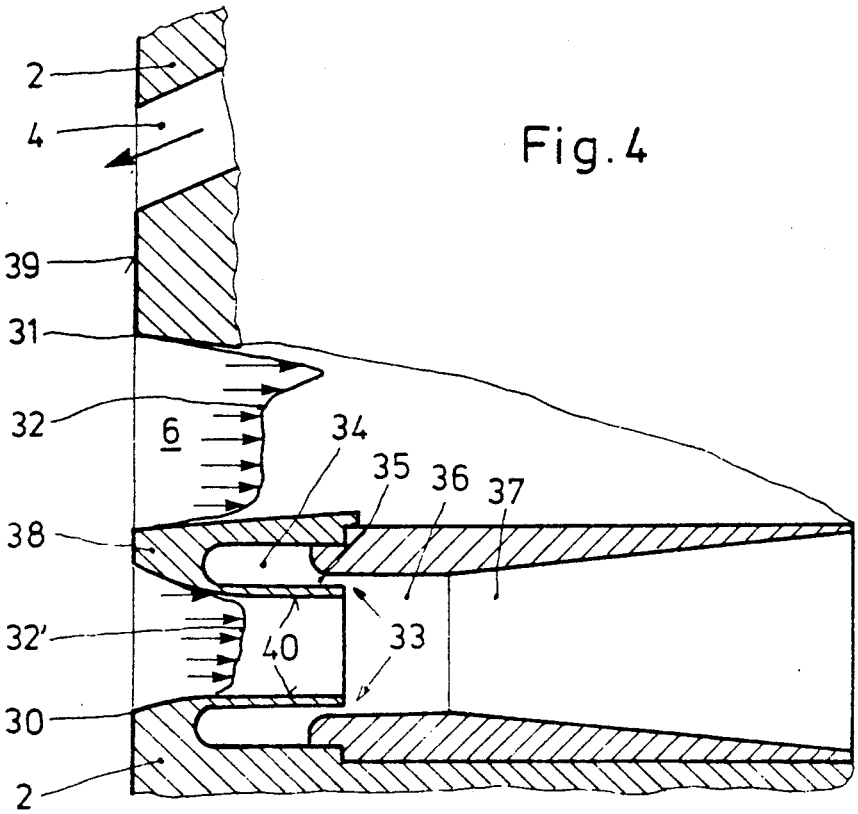
Fig. 4
Fig. 6
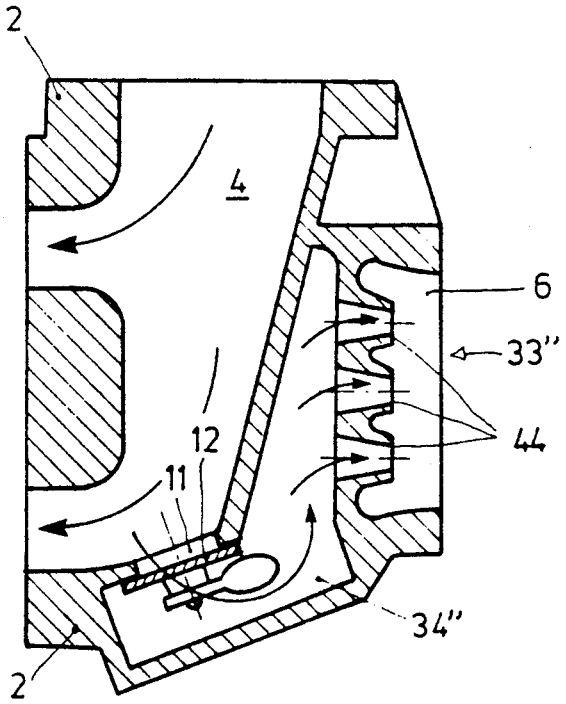
Fig. 5
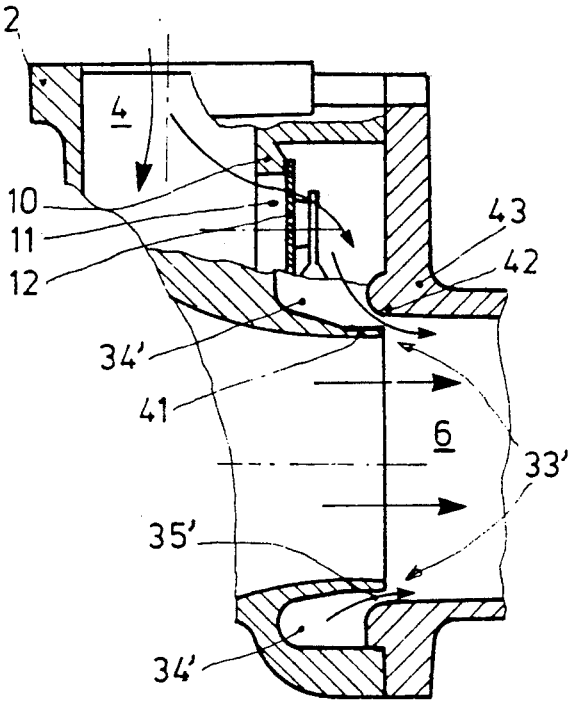

GAS-DYNAMIC PRESSURE-WAVE SUPERCHARGER WITH EXHAUST BYPASS

BACKGROUND OF THE INVENTION

1. Field of the Invention

The invention relates to a gas-dynamic pressure-wave supercharger for the supercharging of an internal combustion engine with an exhaust blow-off valve, which pressure-wave supercharger has a rotor housing with a cell rotor, in which the exhaust gas of the internal combustion engine compresses the combustion air required by the internal combustion engine, furthermore with an air housing, through which atmospheric air is taken in and, after compression in the cell rotor, is fed as charge air to the internal combustion engine, as well as with a gas housing, via which the exhaust gas coming from the internal combustion engine is directed into the cell rotor and, after its expansion in the cell rotor, is directed away via an exhaust outlet connection into an exhaust manifold, an exhaust bypass in the gas housing, with a medium-controlled gate, connecting the high-pressure gas inflow duct to the low-pressure gas outflow duct, which gate i$ in effective connection with a control device actuated by a process pressure of the pressure-wave supercharger.

The use of an exhaust bypass in the case of small engines for passenger cars supercharged by means of pressure-wave machines—with which the peak pressure is limited and which have a broad speed range available —may well be viable. Since such engines have a flexible torque, by virtue of the flat pressure characteristic over the complete engine speed range, here however—in comparison with exhaust turbo charging —on the one hand less exhaust gas has to be blown off into the exhaust and on the other hand blowing off does not have to take place until higher engine speeds. Consequently, the poorer specific fuel consumption due to the unutilized blowing-off only occurs in a narrow range which, experience shows, occurs rarely in the case of a passenger car.

2. Description of Background

A controlling of the charge air pressure by selective blowing-off with a pressure-wave machine mentioned at the beginning is known from British patent specification 775,271. If the exhaust-gas pressure exceeds a predetermined value, a spring-loaded gate arranged in a bypass between high-pressure gas inflow duct and low-pressure gas outflow duct opens. A part of the exhaust gases passes through this bypass directly into the exhaust without going through the pressure-wave process. With such an arrangement, however, the blown-off exhaust gases flow with a speed component transversely to the flow direction of the exhaust gases into the exhaust outlet connection, resulting in the disadvantages described below.

For a satisfactory effective function of the pressure-wave supercharger, the expanded exhaust gases, once they have done their compression work, must be scavenged together with the mixture of air and exhaust gas which has formed in the mixing zone, i.e. in the region of the separating surface of air and exhaust gas, completely into the exhaust outlet connection. This scavenging is supported by the intake air, which enters into the rotor cell on the side opposite the exhaust openings and, as a result, the rotor is cooled at the same time. In order to achieve satisfactory compression efficiencies, however, a further cooling of the rotor is necessary.

For this purpose, the pressure-wave supercharger must take in more air than it gives off compressed air to the engine. This air additionally taken in is called scavenging air and the ratio of scavenging air stream to charge air stream is called the "degree of scavenging" of the pressure-wave supercharger. This degree of scavenging drops with increasing engine speed and decreasing engine loading.

As in the case of a turbo charger, with a pressure-wave supercharger, the blowing-out through the waste gate primarily impairs the overall efficiency, and consequently the specific fuel consumption, but not the degree of scavenging. This is because the scavenging energy reduces approximately proportionally to the compression energy.

With small blow-off streams, the transverse component of the flow into the exhaust duct does not represent a serious impairment of the exhaust stream and consequently of the degree of scavenging. With greater blow-out streams, however, the scavenging is appreciably worsened by the greater transverse component of the entry speed and consequently the compression efficiency is also impaired.

In addition, full-load operating points at high speeds are characterized by an inadequate low-pressure scavenging. The cause resides in the poor distribution of the energy still present in the rotor cells along the low-pressure opening. The speed profile has two pronounced outflow fields, namely one field with high outflow speed in the region of the low-pressure opening edge and one field with low outflow speed in the region of the low-pressure closing edge. This profile is predetermined by the pressure-wave process.

SUMMARY OF THE INVENTION

Accordingly, one object of this invention is to provide a novel supercharger of the type mentioned at the beginning with improved low-pressure scavenging and consequently improved compression efficiency.

According to the invention, this object is achieved by the fact that a waste gate ejector for the exhaust gas to be blown off is arranged in the low-pressure gas outflow duct.

The ejector is preferably accommodated in the region of the closing edge.

It is admittedly already known from German Offenlegungsschrift 3,101,130 in the case of a method of improving the efficiency of an exhaust turbo charger to relieve the blown-off bypass mass flow with the aid of an ejector nozzle and introduce it into the exhaust mass flow in such a way that the counterpressure behind the turbine is reduced. For this purpose, the mouth of the bypass duct into the exhaust duct is designed as an ejector nozzle, which introduces the bypass mass flow into the exhaust mass flow of the turbine approximately in parallel or at an acute angle of up to a maximum of about 30°.

The present invention uses this measure selectively at that point in the exhaust sector at which the energy level of the engine exhaust can be increased with advantage. The scavenging energy is namely thereby increased in the low-pressure range of the supercharger, which leads via reduced heat transfer in turn to the desired improvement in efficiency of the compression.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 and

FIG. 2 show a plan view and side view, respectively, of a pressure-wave supercharger with an exhaust blow-off valve;

FIG. 3 shows a development of a cylindrical section half way up the cells through the rotor and through the adjoining portions of the side parts of the housing;

FIG. 4 shows a first waste gate ejector in a partial cylindrical section according to FIG. 3;

FIG. 5 shows a second waste gate ejector in a partial longitudinal section through the gas housing of a pressure-wave supercharger according to FIGS. 1 and 2;

FIG. 6 shows a third waste gate ejector in a partial longitudinal section like FIG. 5.

DESCRIPTION OF THE PREFERRED EMBODIMENTS

Referring now to the drawings, wherein like reference numerals designate identical or corresponding parts throughout the several views, in FIG. 1, 1 denotes a rotor housing, 2 denotes a gas housing and 3 denotes an air housing of a pressure-wave supercharger. On the gas housing 2 there is on the upper side an exhaust inlet connection 24, through which the exhaust gas coming from the engine, symbolized by the vertical black arrow, enters under pressure. Once it has done the compression work in the rotor, it leaves through the exhaust outlet connection 25 in parallel with the rotor access into an exhaust system (not shown) which is indicated by the horizontal black arrow. As revealed by FIG. 2, the air housing 3 has a horizontal air inlet connection 26, through which air at atmospheric pressure is taken in, and a vertical charge air outlet connection 27, see FIG. 1, through which the charge air compressed in the rotor cells leaves and is fed from there through a charge air line (not shown), on the inlet side, to the engine. Inlet and outlet of the air are represented by the white arrows in the two figures. The inlet can only be represented in FIG. 2, since the air inlet connection is not visible in FIG. 1. The exhaust blow-off valve 12 in the gas housing 2 can be seen from FIG. 2 in greatly simplified representation.

The basic design of a pressure-wave machine and its exact structure can be taken from the publication CH-AL 102,787 of the applicant or from Swiss patent No. 378,595. For the sake of simplicity, the pressure-wave machine shown here in FIG. 3 is represented as a single-cycle machine, which is revealed by the fact that the gas housing 2 and the air housing 3 are provided on their sides facing the rotor 21 with only one high-pressure and one low-pressure opening in each case. In order to explain the function of the system more clearly, the flow directions of the working media and the rotational direction of the pressure-wave machine are denoted by arrows.

The hot exhaust gases of the internal-combustion engine 9 enter through the high-pressure gas inflow duct 4 into the rotor 21 provided with axially straight cells 5, open on both sides, expand therein and leave it via the low-pressure gas outflow duct 6 into the exhaust (not shown). On the air side, atmospheric fresh air is taken in, flows via the low-pressure air inlet duct 7 axially into the rotor 21, is compressed therein and leaves it as charge air via the high-pressure air outlet duct 8 to the engine.

For an understanding of the actual, extremely complex, gas-dynamic pressure-wave process, which is not a subject of the invention, reference is made to the already mentioned Swiss patent 378,595. The process sequence necessary for the understanding of the invention is briefly explained below:

The cell band consisting of the cells 5 is the development of a cylindrical section of the rotor 21, which moves downward upon rotation of the latter in arrow direction. The pressure-wave processes take place inside the rotor and essentially have the effect that a gas-filled space and an air-filled space form. In the first, the exhaust gas expands and then escapes into the low-pressure gas outflow duct 6, while in the second a part of the fresh air taken in is compressed and discharged into the high-pressure air outlet duct 8. The remaining fresh air component is flushed by the rotor into the low-pressure gas outflow duct 6 and consequently brings about the complete departure of the exhaust gases. This scavenging is essential for the process sequence and must be maintained under all circumstances. It must, in any event, be avoided that exhaust gas remains in the rotor 21 and is fed to the engine 9 with the charge air during a subsequent cycle. In addition, the scavenging air cools the cell walls, intensely heated-up by the hot exhaust gases. The principle of direct energy transfer from the flow medium of high energy content—here exhaust gas—to a medium of low energy content—here fresh air taken in—takes place on the basis of nonsteady flow processes, which only begin in the rotor cells. What are involved are pressure-wave effects, which take care of the energy transport.

To be considered as an additional measure, which allows a control of the pressure-wave processes in conformity with speed and load, is the expansion relief 22, which is arranged after, in terms of time, the high-pressure air outlet duct 8. In this relief 22, residual energy from the preceding high-energy process is stored and is passed on with the aid of pressure waves into the low-pressure section, where, as scavenging energy, it decisively influences the low-pressure process. This relief 22 thus ensures that the pressure-wave process does not come to a standstill even at lowest loads, i.e. that the low-pressure scavenging is maintained in every operating state. In the dividing wall 10 between high-pressure gas inflow duct 4 and low-pressure gas outflow duct 6 there is arranged a bypass 11 with a medium-controlled blow-off valve 12—here a gate—as is known from British patent 775,271. In the present case, this gate 12 is pivotally mounted within the bypass 11 at a pivot point not denoted any more specifically. As control means for the gate actuation, high-pressure gas is taken upstream of the pressure wave process via a line 13 and a pressure cell 14 is actuated with it. This pressure cell is subdivided into two chambers 16, 17 by a membrane 15. The membrane 15 interacts with a compression spring 18 and is connected via a linkage 19, 20 to the gate 12.

Depending on machine design and operating conditions, a recirculation of a certain quantity of exhaust gas takes place within the system; for environmental reasons, this is even desired. This is achieved by the fact that a certain proportion of gas passes over to the air side and, in the region of the closing edge 28, is flushed into the high-pressure outlet duct 8. This fact is represented in the diagram by the separating front 29 between air and gas. This separating front is not a sharp delimitation but rather—as already mentioned at the beginning—a relatively broad mixing zone.

In the low-pressure gas outflow duct 6, the speed profile of the expelled exhaust gas is traced by 32. Two pronounced fields can be recognized, on the one hand a field with high outflow speed in the region of the opening edge 31, on the other hand a field with lower outlet speed in the region of the closing edge 30. The zone with no flow between the two fields is due to the unavoidable land 23 in the air housing 3 between the expansion relief 22 and the low-pressure inlet duct 7.

According to the invention, precisely this dead space without through-flow can in fact be utilized as an addition to the effect of the expansion relief 22, by a part of the wall 38 of the waste gate ejector being relocated there. In FIG. 4, this new measure is explained with reference to the developed cylindrical section. The ejector there is an annular nozzle ejector. The actual exhaust gas blow-off valve and the connection from the high-pressure gas inflow duct 4 to the plenum 34 are not represented. From this annular plenum 34, the propellant, i.e. the blown-off exhaust gas, flows through the confuser 35 into the mixing section 36 and from there into the diffusor 37. The four said parts 34 to 37 are completely integrated in the gas housing 2.

The effect of the measure is based on the fact that a lower pressure prevails in the flange plane 39 between rotor and gas housing 2 within the flow-limiting wall 40. The usual low-energy, expanded exhaust gas present there at high speeds consequently experiences an increase in its energy level in the range of influence of the ejector by the pressure difference between the high-pressure zone 4 and low-pressure gas outflow duct 6 then becoming greater. What is essential here is that the low-pressure scavenging energy is increased. This is recognizable in comparison with the representation in FIG. 3 by the now larger speed profile 32'.

A design variant, this time in a partial longitudinal section according to FIG. 1, is represented in FIG. 5. In the case of this solution, it is recognizable that the bypass 11 is merely an opening in the dividing wall or the land 10 between the high-pressure gas inflow duct 4 and the low-pressure gas outflow duct 6. In the case of this representation, it is not possible to show that the annular nozzle ejector 33' can be located in the closing region of the low-pressure gas outflow duct 6. The bypass 11 is covered by the gate 12. It directs the blown-off exhaust gas into the plenum 34' from where it flows through the confuser 35' into the corresponding section of the low-pressure gas outflow duct 6. In the case of this variant, the inner nozzle ring 41 is a component part of the gas housing 2, while the outer nozzle ring 42 is formed by the inflow portion of the exhaust system 43, to be flange-mounted on the gas housing.

A further example is represented in FIG. 6. Here, the bypass 11 closed by the gate 12 opens out directly into the plenum 34''. The exhaust gas passes via a plurality—here three—of individual nozzles 44, which together form the ejector 33'' into the low-pressure gas outflow duct 6, not illustrated any more specifically. It goes without saying that here too the individual nozzles staggered over the height of the duct may be arranged merely in the closing region of the low-pressure gas outflow duct 6, and that the wall extending over the height of the duct, which wall limits the two speed fields, cannot be shown in this representation.

Tests have revealed that it is advantageous in the case of a relatively large length of the mixing section (36 in FIG. 4) to choose different ejector nozzle cross sections. On the other hand, it is appropriate in the case of a short mixing section to provide the individual nozzles with the same outlet cross section.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A gas-dynamic pressure-wave supercharger for the supercharging of an internal combustion engine with an exhaust blow-off valve, which pressure-wave supercharger has a rotor housing (1) with a cell rotor, in which the exhaust gas of the internal-combustion engine (9) compresses the combustion air required by the internal combustion engine, furthermore with an air housing (3), through which atmospheric air is taken in, and after compression in the cell rotor, is fed as charge air to the internal combustion engine, as well as with a gas housing (2), via which the exhaust gas coming from the internal combustion engine is directed into the cell rotor and, after its expansion in the cell rotor, is directed away via an exhaust outlet connection (25) into an exhaust manifold, an exhaust bypass (11) in the gas housing, with a medium-controlled gate (12), connecting the high-pressure gas inflow duct (4) to the low-pressure gas outflow duct (6), which gate (12) is in effective connection with a control device (13-20) actuated by a process pressure of the pressure-wave supercharger, wherein a waste gate ejector (33, 33', 33'') for the exhaust gas to be blown off is arranged in the low-pressure gas outflow duct (6).

2. The pressure-wave supercharger as claimed in claim 1, wherein the ejector is located in the region of the closing edge (30).

3. The pressure-wave supercharger as claimed in claim 1, wherein the waste gate ejector is a multi-nozzle ejector (33'').

4. The pressure-wave supercharger as claimed in claim 1, wherein a plenum (34,34',34'') is arranged between the waste gate ejector (33,33',33'') and the gate (12).

* * * * *